US005871060A

United States Patent [19]

Jensen et al.

[11] Patent Number: 5,871,060

[45] Date of Patent: Feb. 16, 1999

[54] ATTACHMENT GEOMETRY FOR NON-PLANAR DRILL INSERTS

[76] Inventors: Kenneth M. Jensen, 638 W. 1820 N., Orem, Utah 84057; Stephen R. Jurewicz, 3463 Barry Ave., Los Angeles, Calif. 90066

[21] Appl. No.: 803,354

[22] Filed: Feb. 20, 1997

[51] Int. Cl.[6] ..... E21B 10/36

[52] U.S. Cl. ..... 175/420.2; 175/432; 175/434; 175/430

[58] Field of Search ..... 175/425, 426, 175/428, 432, 430, 431, 420.2

[56] References Cited

U.S. PATENT DOCUMENTS

| | | | |
|---|---|---|---|
| Re. 32,036 | 11/1985 | Dennis | 175/329 |
| 2,264,440 | 12/1941 | Havlick | 255/61 |
| 3,745,623 | 7/1973 | Wentorf, Jr. et al. | 29/95 |
| 3,767,971 | 10/1973 | Wentorf, Jr. et al. | 51/307 |
| 3,841,852 | 10/1974 | Wilder et al. | 51/295 |
| 3,871,840 | 3/1975 | Wilder et al. | 51/295 |
| 3,913,280 | 10/1975 | Hall | 51/307 |
| 4,156,329 | 5/1979 | Daniels et al. | 51/295 |
| 4,268,276 | 5/1981 | Bovenkerk | 51/295 |
| 4,311,490 | 1/1982 | Bovenkerk et al. | 51/307 |
| 4,592,433 | 6/1986 | Dennis | 175/329 |
| 4,597,456 | 7/1986 | Ecer | 175/426 X |
| 4,602,691 | 7/1986 | Weaver | 175/329 |
| 4,604,106 | 8/1986 | Hall et al. | 51/293 |
| 4,605,343 | 8/1986 | Hibbs, Jr. et al. | 407/119 |
| 4,629,373 | 12/1986 | Hall | 407/118 |
| 4,632,196 | 12/1986 | Dennis | 175/432 |
| 4,694,918 | 9/1987 | Hall | 175/329 |
| 4,764,434 | 8/1988 | Aronsson et al. | 428/565 |
| 4,784,023 | 11/1988 | Dennis | 76/108 A |
| 4,811,801 | 3/1989 | Salesky et al. | 175/329 |
| 4,913,247 | 4/1990 | Jones | 175/329 |
| 5,016,718 | 5/1991 | Tandberg | 175/333 |
| 5,120,327 | 6/1992 | Dennis | 51/293 |
| 5,135,061 | 8/1992 | Newton, Jr. | 175/428 |
| 5,154,245 | 10/1992 | Waldenstrom et al. | 175/420.2 |
| 5,158,148 | 10/1992 | Keshavan | 175/426 |
| 5,217,081 | 6/1993 | Waldenstrom et al. | 175/420.2 |
| 5,248,006 | 9/1993 | Scott et al. | 175/420.2 |
| 5,264,283 | 11/1993 | Waldenstrom et al. | 428/408 |
| 5,273,125 | 12/1993 | Jurewicz | 175/420.2 |
| 5,279,375 | 1/1994 | Tibbitts et al. | 175/429 |
| 5,316,095 | 5/1994 | Tibbitts | 175/429 |
| 5,335,738 | 8/1994 | Waldenstrom et al. | 175/420.2 |
| 5,348,108 | 9/1994 | Scott et al. | 175/432 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,435,403 | 7/1995 | Tibbitts | 175/432 |
| 5,437,343 | 8/1995 | Cooley et al. | 175/431 |

(List continued on next page.)

FOREIGN PATENT DOCUMENTS

| | | | |
|---|---|---|---|
| 2 240 797 | 8/1991 | United Kingdom | E21B 10/46 |
| 2 290 326 | 12/1995 | United Kingdom | E21B 10/45 |
| 2 290 327 | 12/1995 | United Kingdom | E21B 10/46 |
| 2 290 328 | 12/1995 | United Kingdom | E21B 10/46 |

*Primary Examiner*—Roger Schoeppel
*Attorney, Agent, or Firm*—Lloyd W. Sadler

[57] ABSTRACT

A manufacturing method and a drill bit composite insert for performing mechanical actions that require high wear and impact resistance are provided. The composite insert has improved interface strength and improved residual stress distribution. These improved features are achieved by chemically and mechanically attaching the layer of abrasion and corrosion resistant polycrystalline material to the substrate that ordinarily is tungsten carbide. The chemical bond is formed during high pressure and high temperature sintering. Mechanically, the abrasion and corrosion resistant layer is attached to the substrate by means of irregularities on the substrate's top surface. These irregularities are designed to distribute stress and minimize the number of features that would lead to crack formation and subsequent failure of the insert. These surface irregularities are not sculptured features on the substrate that are of difficult or impossible manufacture, but they can be manufactured by pre- or post-sintering shaping methods.

25 Claims, 10 Drawing Sheets

U.S. PATENT DOCUMENTS

| | | | |
|---|---|---|---|
| 5,443,565 | 8/1995 | Strange, Jr. | 175/431 |
| 5,460,233 | 10/1995 | Meany et al. | 175/428 |
| 5,469,927 | 11/1995 | Criffin | 175/432 |
| 5,472,376 | 12/1995 | Olmstead et al. | 451/540 |
| 5,486,137 | 1/1996 | Flood et al. | 451/540 |
| 5,494,477 | 2/1996 | Flood et al | 451/540 |
| 5,544,713 | 8/1996 | Dennis | 175/434 |
| 5,564,511 | 10/1996 | Frushour | 175/431 |

ATTACHMENT GEOMETRY FOR NON-PLANAR DRILL INSERTS

BACKGROUND OF THE INVENTION

1. Field of the Invention

The present invention relates generally to diamond enhanced carbide inserts that can be used for performing mechanical actions, such as drilling through rock or other hard materials, that require high wear and impact resistance. More specifically, the present invention relates to diamond enhanced carbide inserts that have improved interface strength and also improved residual stress distribution.

2. Description of Related Art

Polycrystalline diamond compacts, buttons, cutters, inserts, and cutting tools (hereinafter referred to as "inserts") are widely used in bits such as those for oil field drilling and mining operations as well as in the cutting tool industry. A typical insert is composed of an abrasion resistant material embedded into or covering a substrate.

While many inserts are made from carbide only, diamond enhanced inserts are manufactured by bonding a layer or other concentrated mass of polycrystalline diamond onto or into a sintered carbide substrate by the application of high pressure and temperature in a manner well known to those skilled in the art. One such method involves sintering the polycrystalline material directly to a cemented carbide substrate by means of high pressure and high temperature. This method of forming inserts is in wide use in the diamond enhanced carbide insert industry. During this process, cobalt, nickel, iron or similar metals are used to act as a sintering aid for the diamond. Such metal may be premixed with the diamond, or swept from the substrate into the diamond, forming a matrix which bonds the diamond and carbide together at the interface and facilitates the formation of solid polycrystalline diamond.

When in operation, an insert is subject to enormous stress. Such stress is a cause of crack initiation and subsequent failure. Delamination, exfoliation and fracture are typical failure types. A variety of loading conditions may be experienced by inserts due to variation in application and geologic formation. The mechanics which dictate insert failure are further complicated by complex residual stresses which result in inserts due to the mismatch of thermal expansion coefficient and elastic modulus of dissimilar materials during processing. Failure mechanisms are therefore varied and failure criteria are not well established. Because of this limited understanding, one would expect that a diversity of attempts to make impact and wear resistant inserts have been undertaken. The works listed below are related to previous contributions to the engineering of inserts and some of their relevant components.

U.S. Pat. No. 2,264,440 describes a diamond abrasive drill bit for drilling holes for blasting or grouting where no core is required.

U.S. Pat. No. 3,745,623 describes diamond tools and superpressure processes for the preparation thereof, the diamond content being supported on and being directly bonded to an extremely stiff substrate, often made of sintered carbide.

U.S. Pat. No. 3,767,371 discloses abrasive bodies that comprise combinations of cubic boron nitride crystals and sintered carbide.

U.S. Pat. No. 3,841,852 describes abraders, abrasive particles and methods for producing same, where the preferred primary abrasive is a diamond.

U.S. Pat. No. 3,871,840 reveals how abrasive particles are improved in function by encapsulating them with a metallic envelope.

U.S. Pat. No. 3,913,280 describes a polycrystalline diamond composite and a method for forming diamond to diamond bonds between adjacent diamond particles.

U.S. Pat. No. 4,156,329 describes a method for fabricating a drill bit comprised of a plurality of composite compact cutters.

U.S. Pat. No. 4,268,276 describes a compact for cutting, drilling, wire drawing and shaping tools, consisting essentially of a porous mass of self-bonded, boron-doped diamond particles and catalyst-solvent material.

U.S. Pat. No. 4,311,490 discloses an improved process for preparing a composite compact wherein a mass of abrasive crystals, a mass of metal carbide, and a bonding medium are subjected to a high-temperature/high pressure process for providing a composite compact. The resulting composite compact is also disclosed therein.

U.S. Pat. No. Re. 32,036 discloses a drill bit for connection on a drill string, the drill bit having a hollow tubular body with an end cutting face and an exterior peripheral stabilizer surface with cylindrical sintered carbide inserts positioned therein.

U.S. Pat. No. 4,592,433 discloses a cutting blank that comprises a substrate formed of a hard material and including a cutting surface with a plurality of shallow grooves that contain strips of a diamond substance.

U.S. Pat. No. 4,604,106 reveals a composite polycrystalline diamond compact comprising at least one layer of diamond crystals and precemented carbide pieces which have been pressed under sufficient heat and pressure to create composite polycrystalline material wherein polycrystalline diamond and the precemented carbide pieces are interspersed in one another.

U.S. Pat. No. 4,605,343 discloses a sintered polycrystalline diamond compact having an integral metallic heat sink bonded to and covering at least he outer diamond surface.

U.S. Pat. No. 4,629,373 discloses a polycrystalline diamond body with a plurality of faces having enhanced surface irregularities over at least a portion of at least one of the faces, the polycrystalline diamond body with the enhanced surface irregularities being attached to other materials such as metal.

U.S. Pat. No. 4,694,918 describes an insert that has a tungsten carbide body and at least two layers at the protruding drilling portion of the insert. The outermost layer contains polycrystalline diamond and the remaining layers adjacent to the polycrystalline diamond layer are transition layers containing a composite of diamond crystals and precemented tungsten carbide, the composite having a higher diamond crystal content adjacent the polycrystalline diamond layer and a higher precemented tungsten carbide content adjacent the tungsten carbide layer.

U.S. Pat. No. 4,764,434 reveals a polycrystalline diamond tool comprising a diamond layer bonded to a support body having a complex, non-planar geometry by means of a thin and continuous layer of a refractory material applied by a coating technique, such as PVD or CVD.

U.S. Pat. No. 4,811,801 describes an insert that includes a polycrystalline diamond surface on an insert body having a head portion made from a material with elasticity and thermal expansion properties advantageously tailored for use in rock bits, as well as rock bits made with such inserts.

U.S. Pat. No. 4,913,247 describes a drill bit having a body member with cutter blades having a generally parabolic bottom profile.

U.S. Pat. No. 5,016,718 reveals a polycrystalline diamond cutting element whose mechanical strength is improved due to the fact that the edge of the element is rounded with a small visible radius.

U.S. Pat. No. 5,120,327 describes a composite for cutting in subterranean formations, comprising a cemented carbide substrate and a diamond layer adhered to the surface of the substrate.

U.S. Pat. No. 5,135,061 describes a preform cutting element for rotary drill bit for use in drilling or coring holes in substrate formations which includes a cutting table of superhard material such as polycrystalline diamond.

U.S. Pat. No. 5,154,245 relates to a rock bit insert of cemented carbide for percussive or rotary crushing rock drilling. The button is provided with one or more bodies of polycrystalline diamond in the surface produced at high pressure and high temperature in the diamond stable area. Each diamond body is completely surrounded by cemented carbide except the top surface.

U.S. Pat. No. 5,158,148 describes cemented tungsten carbide rock bit inserts having diamond particles dispersed therein for enhanced hardness and wear resistance.

U.S. Pat. No. 5,217,081 relates to a rock bit insert of cemented carbide provided with one or more bodies or layers of diamond and/or cubic boron nitride produced at high pressure and high temperature in the diamond or cubic boron nitride stable area. The body of cemented carbide has a multi-structure containing eta-phase surrounded by a surface zone of cemented carbide free of eta-phase and having a low content of cobalt in the surface and a higher content of cobalt next to the eta-phase zone.

U.S. Pat. No. 5,248,006 describes a cutting structure having diamond filled compacts for use in an earth boring bit of the type having one or more rotable cones secured to bearing shafts.

U.S. Pat. No. 5,264,283 relates to buttons, inserts and bodies that comprise cemented carbide provided with bodies and/or layers of CVD- or PVD-fabricated diamond and then high pressure/high temperature treated in the diamond stable area.

U.S. Pat. No. 5,279,375 describes a multidirectional drill bit cutter comprising a cylindrical stud having a layer of polycrystalline diamond formed thereabout.

U.S. Pat. No. 5,335,738 relates to a button of cemented carbide. The button is provided with a layer of diamond produced at high pressure and high temperature in the diamond stable area. The cemented carbide has a multi-phase structure having a core that contains eta-phase surrounded by a surface zone of cemented carbide free of eta-phase.

U.S. Pat. No. 5,351,772 discloses a substantially polycrystalline diamond compact element for drilling subterranean formations. The cutting element includes a cemented carbide substrate having radially extending raised lands on one side thereof, to and over which is formed and bonded a polycrystalline diamond table.

U.S. Pat. No. 5,355,969 describes a cutting implement formed from a substrate of carbide, or other hard substance, bonded to a polycrystalline layer which serves as the cutting portion of the implement. The interface between the substrate and polycrystalline layer is defined by surface topography with radially spaced-apart protuberances and depressions forming smooth transitional surfaces.

U.S. Pat. No. 5,379,854 discloses a cutting element which has a metal carbide stud with a plurality of ridges formed in a reduced or full diameter hemispherical outer end portion of said metal carbide stud. The ridges extend outwardly beyond the outer end portion of the metal carbide stud. A layer of polycrystalline material, resistant to corrosive and abrasive materials, is disposed over the ridges and the outer end portion of the metal carbide stud to form a hemispherical cap.

U.S. Pat. No. 5,435,403 describes a cutting element having a substantially planar table of superhard material mounted on a substrate or backing.

U.S. Pat. No. 5,437,343 describes a diamond cutting element including a substantially planar diamond table having a periphery defined by a multiple chamfer.

U.S. Pat. No. 5,443,565 describes a drill bit characterized by a body fitted with multiple, spaced blades having a forward sweep relative to the center of the bit and cutting elements embedded in the blades at a selected back rake and side rake.

U.S. Pat. No. 5,460,233 describes a rotary drag bit for drilling hard rock formations with substantially planar PDC cutting elements having diamond tables backed by substrates which flare or taper laterally outwardly and rearwardly of the cutting edge of the diamond table.

U.S. Pat. No. 5,472,376 describes a tool component comprising an abrasive compact layer bonded to a cemented carbide substrate along an interface.

U.S. Pat. No. 5,486,137 discloses an abrasive tool insert having an abrasive particle layer having an upper surface, an outer periphery, and a lower surface integrally formed on a substrate which defines an interface therebetween.

U.S. Pat. No. 5,494,477 describes an abrasive tool insert comprising a cemented substrate and a polycrystalline diamond layer formed thereon by high pressure, high temperature processing.

U.S. Pat. No. 5,544,713 discloses a cutting element with a metal carbide stud that has a conic tip formed with a reduced diameter hemispherical outer tip end portion of said metal carbide stud. A corrosive and abrasive resistant polycrystalline material layer is also disposed over the outer end portion of the metal carbide stud to form a cap, and an alternate conic form has a flat tip face. A chisel insert has a transecting edge and opposing flat faces, which is also covered with a polycrystalline diamond compact layer.

U.K Pat. Application No. 2,240,797 A discloses a preform cutting element for a rotary drill bit comprising a polycrystalline diamond cutting table bonded to a coextensive substrate of cemented tungsten carbide.

Descriptions of methods for applying a layer or pocket of polycrystalline diamond to a sintered carbide substrate can be found in some of the afore-mentioned patents. Ordinarily, the method of sintering polycrystalline diamond to a top surface on a cylindrically shaped substrate is taught. This top surface may be flat, or shaped and is frequently non-planar. Some patents teach the application of diamond to a carbide substrate with a transition layer between the diamond and the substrate, said transition layer being a mixture of diamond and carbide. Still other patents reveal the use of diamond-filled pockets and grooves in a carbide substrate, with no continuous diamond surface covering the entire substrate upper surface or with a continuous coverage of a flat surface with irregularities. Related substrates are characterized by a hemispherical outer end portion with a plurality of ridges that extend outwardly. Some techniques use CVD or PVD films applied to the substrate prior to the high pressure and high temperature attachment of the diamond layer to the substrate. Embodiments are also produced by applying some of the afore-mentioned techniques to a heterogeneous substrate that in some instances has an eta-phase core.

Many related inventions have embodiments with irregularities in the substrate's top surface. Such irregularities ordinarily give rise to sharp features in the form of edges and corners. Due to stress concentration, these sharp features are known to be typical loci of crack formation. While surface topography improves attachment area and mechanical resistance to laminar shear, it must be observed that sharp surfaces cause stress to be concentrated not only under service loads, but also due to residual stress present within inserts under no applied external load.

The combination of diamond and carbide in a composite insert provides superior abrasion resistance and impact resistance while in service. Shear and percussion tools for drilling or cutting through rock or other hard materials also benefit from the insert's high abrasion and impact resistance. Amongst the different forms of diamond, polycrystalline diamond is particularly useful as an abrasion and corrosion resistant material. The most common geometric configuration for inserts is embodied by a cylindrical substrate with flat, conical, hemispherical, ovoidal, or other top surface, which is coated with polycrystalline diamond. The cylinder's top surface may also be modified to hold pockets or grooves of diamond, a practice common with flat diamond/substrate interfaces and familiar to those well versed in the art. Each of the afore-mentioned patents and elements of related art is hereby incorporated by reference in its entirety for the material disclosed therein.

SUMMARY OF THE INVENTION

It is desirable to provide drill inserts for use in the drilling of geological formation. Furthermore, it is desirable that these drill inserts be abrasion resistant and that they be designed so as to minimize the concentration of stresses within the insert. Additionally, it is desirable to provide drill inserts having both a substrate and an abrasion resistant surface with substrate surface irregularities that provide a strong bonding surface between the substrate and the abrasion resistant surface.

The general objective of this invention is to provide a diamond enhanced carbide insert with an improved attachment geometry which provides improved diamond/carbide interface strength.

It is a further objective of this invention to provide a composite insert wherein the materials are joined mechanically through surface geometry, in addition to the chemical bonding which occurs at the diamond/carbide interface.

It is a further object of this invention to provide a composite insert that is characterized by a geometry which favorably redistributes the stress at the diamond/carbide interface and improves the overall stress pattern present in the insert.

It is a further objective of this invention to provide a composite insert that has a macroscopic composite layer with properties intermediate to the respective properties of diamond and carbide.

It is a further objective of this invention to provide a composite insert that has a non-planar substrate top surface that is not limited to a hemispherical shape, and where the non-planar surface may be concave, convex, or have some convex regions and some concave regions.

It is a further objective of this invention to provide a composite insert having a substrate with top surface irregularities that can be isolated or continuous, regularly or irregularly distributed.

It is a further objective of this invention to provide a composite insert which is designed to minimize crack formation centers. Furthermore, it is an object of this invention to provide crack formation minimization by chemically and mechanically bonding the substrate to the abrasion resistant material and by appropriately shaping the substrate's top surface irregularities.

It is a further objective of this invention to provide a composite insert having the entire substrate top surface covered by a layer of abrasion resistant material.

It is a further objective of this invention to provide a composite insert that has a substrate with top surface irregularities that can be easily manufactured and produced.

It is a further objective of this invention to provide a composite insert whose substrate's horizontal cross section can be circular, polygonal, ellipsoidal, or having some rectilinear and some curved or arcuate sides, such as a cross section with a circular shape.

These and other objectives of this invention are achieved by a method comprising the steps of shaping the substrate's top surface irregularities before or after sintering the substrate, attaching the abrasion resistant layer to the substrate by sintering through high pressure and high temperature processing familiar to those knowledgeable in the art.

Furthermore, the specific reference to diamond and carbide as components of the insert is not limiting, but merely illustrative. For example, the abrasion and corrosion resistant layer may be polycrystalline diamond, other forms of diamond, any of the forms of boron nitride that have properties similar to diamond, or any combination thereof. Other abrasives that by themselves individually or in combination may be useful for certain purposes include aluminum oxide, tungsten carbide (whether as cast eutectic, mono carbide, or ditungsten carbide), chromium carbide, tantalum carbide, titanium carbide, molybdenum carbide, zirconium carbide, and silicon carbide. Similarly, the impact resistant substrate may be any of the materials that contain metal carbides capable of being sintered. Drill bits provided with the inserts that embody this invention are useful in mechanical operations such as drilling, cutting, abrading, crushing, shaping, extruding, or any combination thereof.

Additional objects, features and advantages of this invention will become apparent to persons of ordinary skill in the art upon reading the remainder of the specification and upon referring to the attached Figures.

BRIEF DESCRIPTION OF THE DRAWINGS

In FIG. 4*a* the polycrystalline diamond layer is shown covering completely the substrate's curved upper surface and the substrate surface has irregularities in the form of grooves (also shown in FIG. 4*b*) as the annular regions between concentric circumferences.

FIG. 5*a* also shows an insert with the polycrystalline diamond layer covering completely the substrate's curved upper surface which has irregularities in the form of depressions. These irregularities are shown in FIG. 5*b* as small circles.

FIG. 6*a* shows an insert with the polycrystalline diamond layer completely covering the upper surface of a substrate which is generally conical or hemispheric in shape. Irregularities in the form of grooves, shown in FIG. 6*b* as the annular regions between concentric circumferences.

DETAILED DESCRIPTION OF THE EMBODIMENTS OF THE INVENTION

Figure 1A:
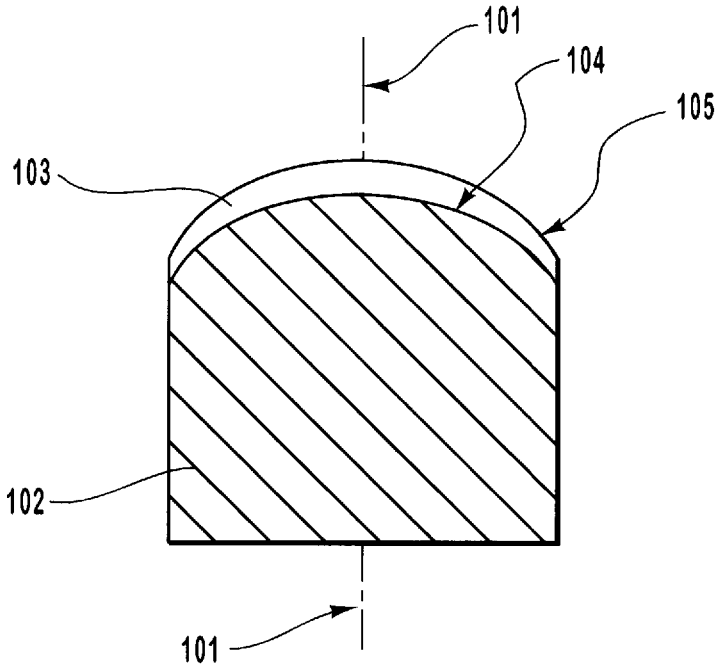
FIG. 1*a* shows the cross-sectional view of an insert made up of a substrate whose curved and smooth upper surface is entirely covered by a layer of polycrystalline diamond.

The illustrative embodiments of the invention exemplify the application of the useful characteristics discussed below, and further reference to these and other useful and novel features is made in the following discussion of each illustrative embodiment.

Coating the substrate of a drill insert with polycrystalline diamond provides a protective layer resistant to abrasion and corrosion. Where the substrate surface of the insert is modified to distribute the mechanical stresses as the diamond/substrate surface improved life of the insert results. Specifically, residual stresses result when diamond and carbide are bonded at high temperature and pressure. The cause of these residual stresses is the mismatch between the properties of the diamond and the substrate material; in particular, the respective thermal expansion coefficients are different and so are the respective elastic moduli. The introduction of surface irregularities in the form of grooves or pockets to be filled with diamond provides a composite layer on a macroscopic scale; this macroscopic layer decreases the interfacial residual stress. Furthermore, the surface modifications also serve to avoid a planar or smoothly curved interface where shearing can most easily break the diamond/carbide bond. Because the grooves or pockets force any expected shear to propagate through one of the two materials, rather than along the bond surface between them, breaking at the interface by shear is much less likely than the interface most commonly used in the art. In particular, this relationship between the effects of surface irregularities and breaking at the interface has been shown to exist with a planar interface which is relatively easy to test in planar shear.

The afore-mentioned objects as well as others apparent to those familiar with the art are accomplished by the present invention by modifying the top surface of the substrate, be it of any non-planar configuration, to have grooves, pockets, protuberances or other deviations from an otherwise smooth surface geometry. The introduction of said surface modifications provides mechanical support to a chemical bond, and it also provides a layer of material whose composite properties are intermediate between those of diamond and carbide. The surface modifications improve not only the strength of the inserts at the time they are loaded in service, but also the residual stress characteristics prior to loading. By eliminating or reducing the number of plane and dihedral angles (sharp angles and/or corners) defined by features contained in the surface modifications, the number of stress concentrations that could lead to crack formation is reduced. Whereas other related inventions use diamond-filled pockets and grooves in a carbide substrate, the insert's diamond surface is generally not as continuous as it is in the present invention.

These useful surface modifications may be accomplished in a variety of ways, the most common being the shaping of the carbide before sintering, so the carbide is pressed and sintered to yield the desired shape. Other methods of shaping include grinding as well as electrode discharge machining and electrode discharge grinding. Additional modifications to the carbide surface may be accomplished through chemical methods such as etching, which may provide additional surface roughness and attachment area.

As to the attachment of a superhard abrasion and corrosion resistant material to the insert's substrate, the preferred method is direct sintering of polycrystalline diamond to a cemented carbide substrate by means of high pressure and high temperature. The improved bond in this invention's embodiments is formed by use of mechanical interlocking at the interface. The improved bond of this invention tends to distribute stresses at the interface. Thus, no reliance is placed in the present invention on a transition layer between the substrate and the diamond, whether this transition layer is realized in the form of PVD or CVD films or in the form of a mixture of diamond and carbide. A benefit of the method used in the present invention is the increased attachment strength derived from simultaneous bonding of the polycrystalline diamond to itself as well as to the carbide substrate. Furthermore, carbide substrates that are homogeneous in composition are parts of typical embodiments of the present invention, contrary to related inventions that rely on a substrate with an eta-phase core.

The present invention's geometry modifications at the diamond/carbide interface are useful because:

(a) The modifications provide a means of changing the residual stress characteristics of the insert. A smooth interface allows for direct transmittal of forces along the interface; this is avoided when the surface has been modified by the introduction of irregularities as exemplified by the embodiments of the present invention shown in the figures further discussed below.

(b) The modifications improve the attachment strength at the interface, particularly when the insert is loaded along a plane coincident or tangent to some portion of the interface. This increased attachment strength is well documented with inserts that have flat interfaces, where the shear strength at the interface is easy to test.

(c) The modifications provide a macroscopic composite diamond/carbide layer that has properties intermediate to those of diamond and carbide alone, thereby decreasing stress intensity at the interface.

(d) In addition, the modifications also relieve the stresses that originate at the composite layer with intermediate elasticity modulus and thermal expansion coefficient.

FIGS. 1*a*, 1*b*, 2*a*, 2*b*, 3*a*, and 3*b* represent elements of related inventions that are reproduced here for comparative purposes and as aids in introducing terminology.

Figure 1B:
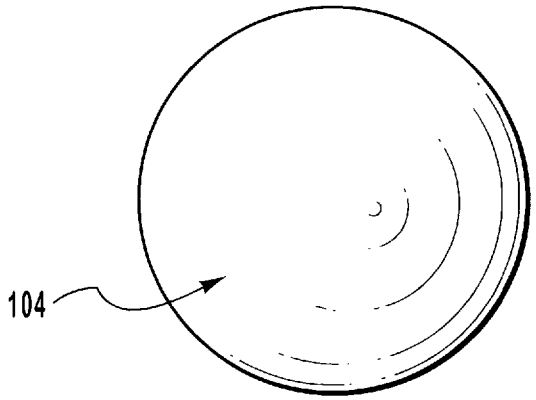
FIG. 1*b* shows the corresponding top view of the substrate's upper surface.

FIG. 1*a* shows an insert's cross section along the insert's longitudinal axis 101. In this embodiment, the polycrystalline diamond (PCD) layer 103 is attached directly to the carbide substrate's 102 curved top surface 104, and the PCD layer 103 covers the entire substrate's top surface 104. The top surface 105 of the PCD layer is also curved. Rotation of this cross section about the longitudinal axis 101 generates the insert represented by FIGS. 1*a* and 1*b*. FIG. 1*b* shows a top view of the carbide substrate prior to attachment to the PCD layer. The substrate's top surface 104 appears smooth and has no irregularities in this top view.

Figure 2A:
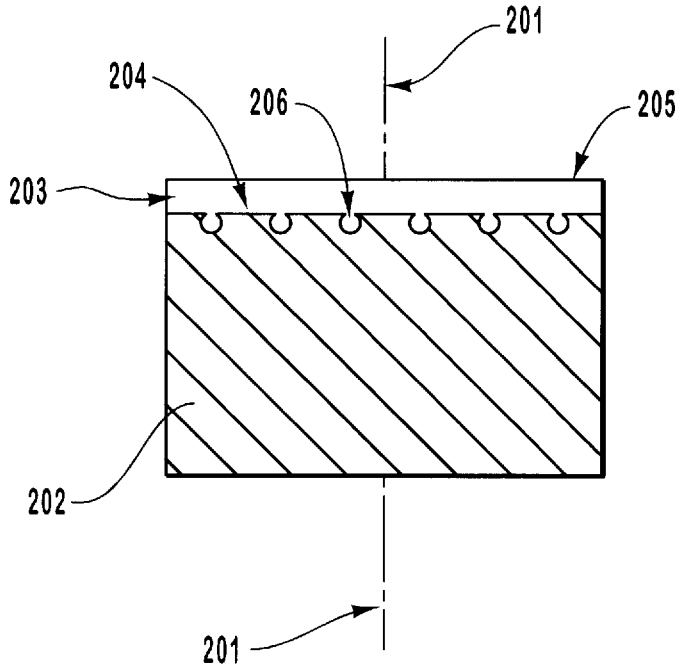
FIG. 2*a* shows a cross-sectional view of an insert with a planar polycrystalline diamond top surface.
Figure 2B:
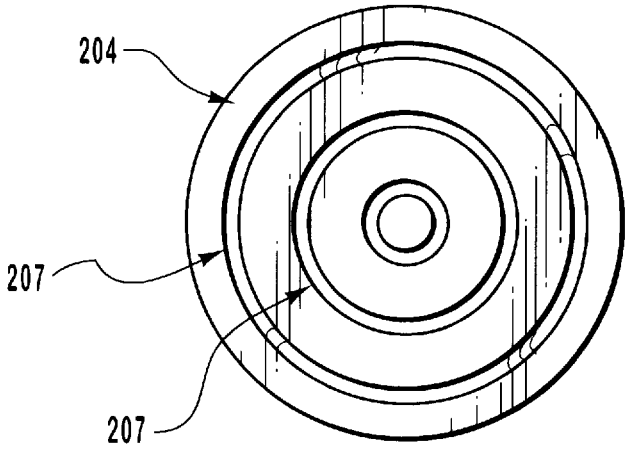
FIG. 2*b* shows the corresponding top view of the substrate's upper surface showing the concentric rings that occur at an otherwise planar upper surface of the substrate.

FIG. 2*a* shows the cross section of an insert along it's longitudinal axis 201. The substrate's 202 top surface 204 has grooves that in this cross section appear as concave features 206 along the line that represents the top surface 204. A PCD layer 203 fills these grooves 206 and covers the substrate's top surface 204 completely. The PCD layer's top surface 205 is planar. Rotation of this cross section about the longitudinal axis 201 generates the insert represented by FIGS. 2*a* and 2*b*. FIG. 2*b* shows a top view of the carbide substrate prior to attachment of the PCD layer. The substrate's top surface 204 contains concentric rings 207 that are the top views of the grooves' perimeters, said grooves represented in FIG. 2*a* by the concave features 206.

Figure 3A:
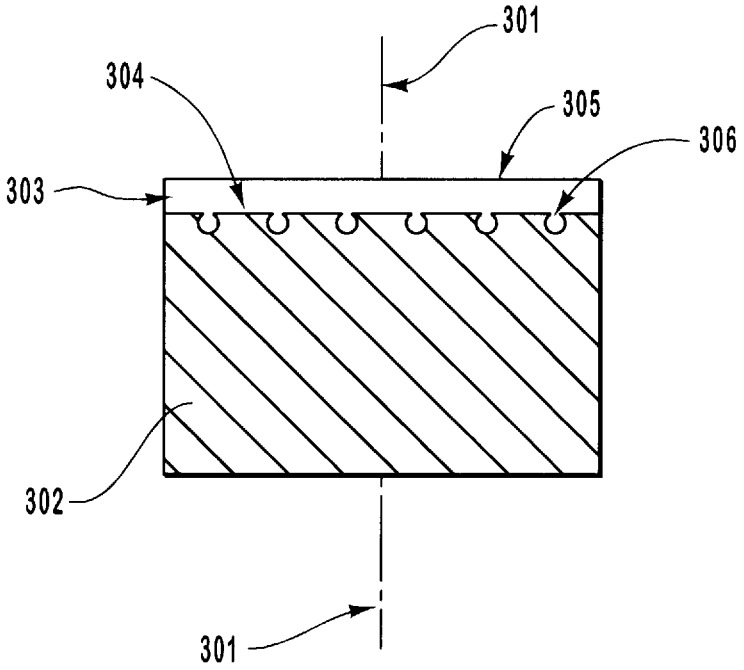
FIG. 3*a* shows a cross-sectional view of an insert with a planar polycrystalline diamond top surface.
Figure 3B:
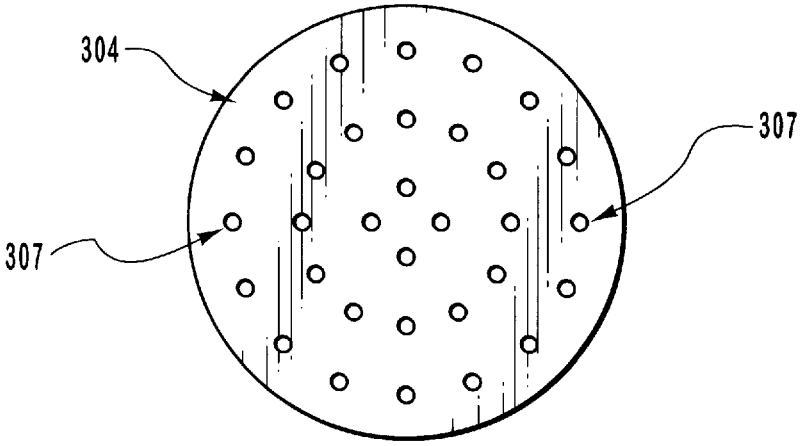
FIG. 3*b* shows the top view of the substrate showing the depressions distributed across an otherwise planar interface.

FIG. 3*a* is similar in appearance to FIG. 2*a*. FIG. 3*a* also shows an insert's cross section along the insert's longitudinal axis 301, however in this insert the carbide substrate 302 top surface 304 has small pockets that this cross section displays as concave features 306 along the line that represents the substrate's top surface 304. A PCD layer 303 fills these pockets 306 completely and covers the substrate's top surface 304 completely. The PCD layer's top surface 305 is planar. FIG. 3*b* shows a top view of the carbide substrate prior to attachment of the PCD layer. The substrate's top surface 304 contains circular features 307 that are the views of the pockets represented in FIG. 3*a* by the concave features 306.

FIGS. 4*a*, 4*b*, 5*a*, 5*b*, 6*a*, 6*b*, 7*a*, 7*b*, 8*a*, 8*b*, 9*a*, 9*b*, 10*a*, 10*b*, 11*a*, 11*b*, 11*c*, 11*d*, 11*e* and 11*f* show features of various embodiments of the present invention. These embodiments of the invention are included to be illustrative of the invention and not exhaustive of all embodiments of the invention.

Figure 4A:
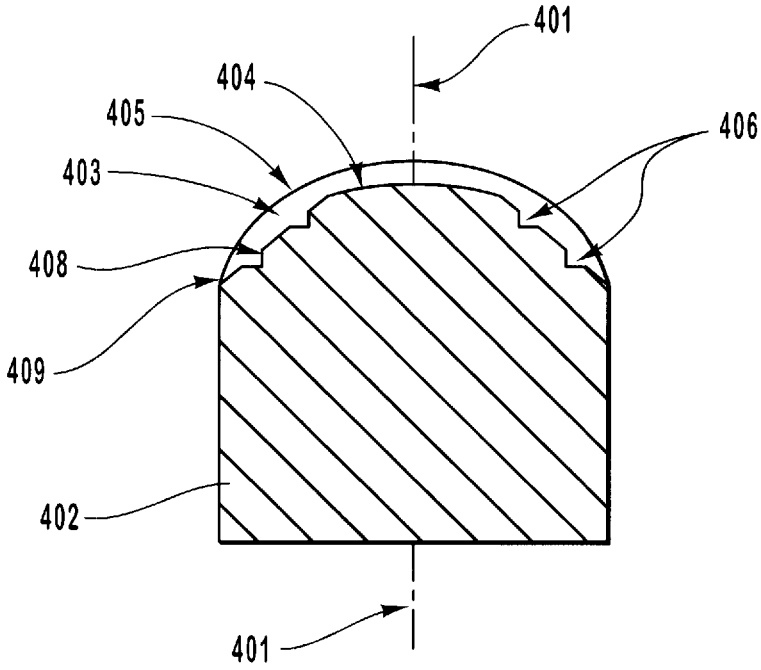
FIG. 4*a* shows a cross-sectional view of an insert which is an embodiment of the invention.
Figure 4B:
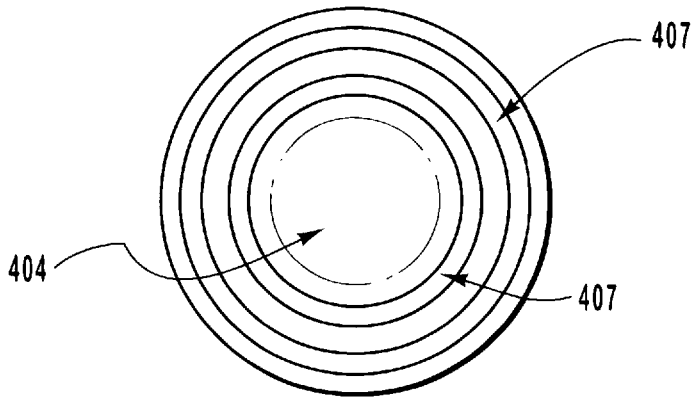
FIG. 4*b* shows the top view of the corresponding substrate that exemplify an embodiment of the present invention.
Figure 4C:
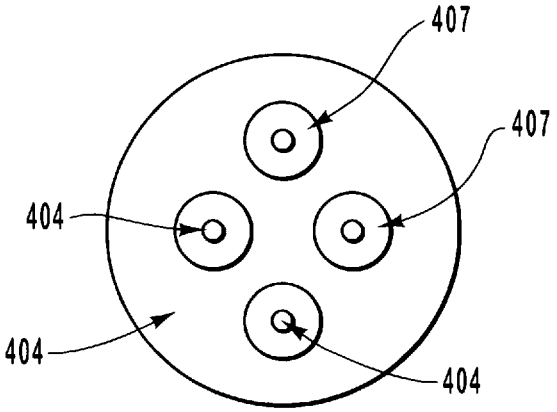
FIGS. 4*c*, 4*d*, 4*e*, 4*f*, 4*g*, and 4*h* are top views of the insert's substrate showing different types of surface irregularities.
Figure 4D:
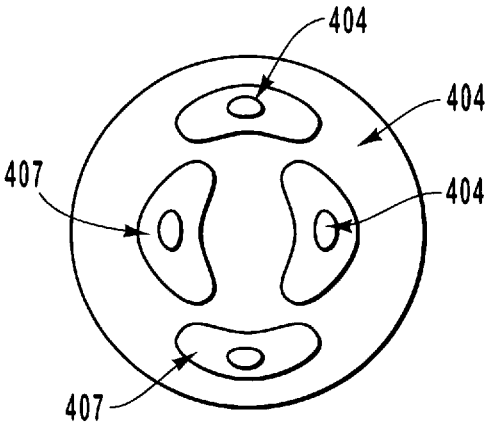
Figure 4E:
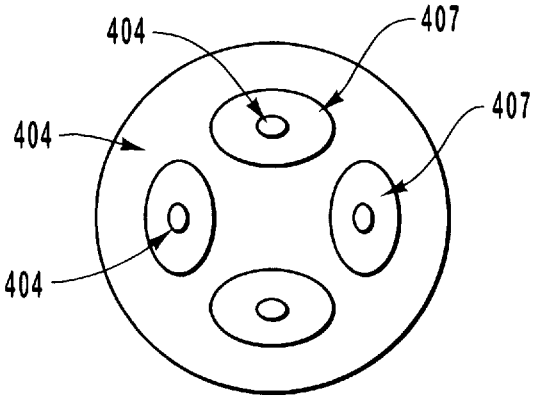
Figure 4F:
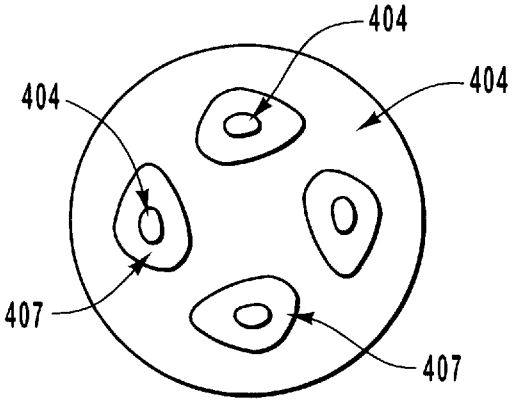
Figure 4G:
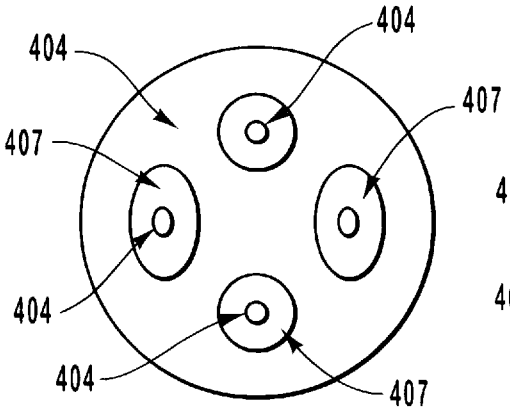
Figure 4H:
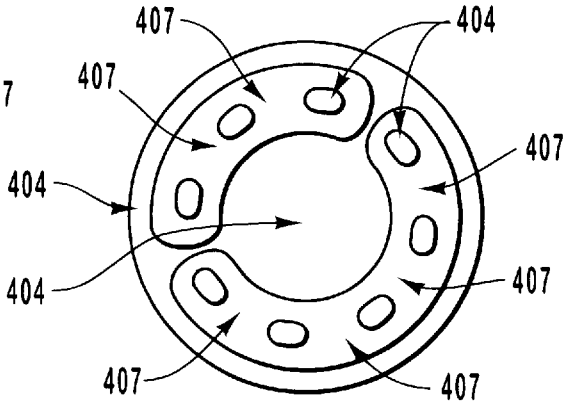

FIG. 4*a* shows an insert's cross section along the insert's longitudinal axis 401. The substrate 402 top surface 404 has irregularities that are exemplified by a plurality of notches 406 in this cross section, said notches 406 being separated by unmodified curved portions of the substrate's curved upper surface 404. These notches 406 may have one side parallel to the longitudinal axis 401 and the other side perpendicular to the longitudinal axis 401 forming a right angle within the notch. Alternatively, the notches 406 they may have their sides forming any other angle with respect to the longitudinal axis 401 that causes the notches' 406 sides to form an angle within the notch greater than 0 and less than 180 degrees. The inside corner 408 and the outside corner 409 may also be radiused or chamfered to reduce or remove sharp edges. A PCD layer 403 fills these irregularities 406 and covers the substrate's top surface 404 completely. The PCD layer's top surface 405 is also curved. Surfaces 404 and 405 may be both convex (as shown in FIG. 4*a*), or both concave, or one concave and the other one convex. FIG. 4*b* shows a top view of the substrate prior to attachment of the PCD layer. The substrate's top surface 404 contains a plurality of concentric circumferences whose comprised annular regions 407 represent top views of the plurality of surface irregularities 406 in FIG. 4*a*. The plurality of surface irregularities 406 in FIGS. 4*a* and 4*b* are drawn as progressing concentrically outward from the longitudinal axis 401, but their distribution may be uniform or non-uniform, they may be equispaced or irregularly spaced, and their depths and widths may be constant or variable. Furthermore, said surface irregularities 406 may be arranged in a variety of patterns on the substrate's top surface 404. For example, FIG. 4*c* shows a top view of the substrate prior to attachment of the PCD layer, said substrate's top surface 404 containing a plurality of isolated annular features 407 that are still consistent with the cross section represented in FIG. 4*a*. Furthermore, features 407 do not have to be circular. Alternatively to the embodiment of the invention shown in FIG. 4*b*, features 407 can be ellipsoidal, ovoidal, lenticular, polygonal, or a combination thereof, isolated or interconnected, as illustrated by the top views shown in FIGS. 4*d*, 4*e*, 4*f*, 4*g*, 4*h*, or of any other shape or combination of shapes that performs the same functions as the embodiment exemplified by FIGS. 4*a,b,c,d,e,f,g,h*.

Figure 5A:
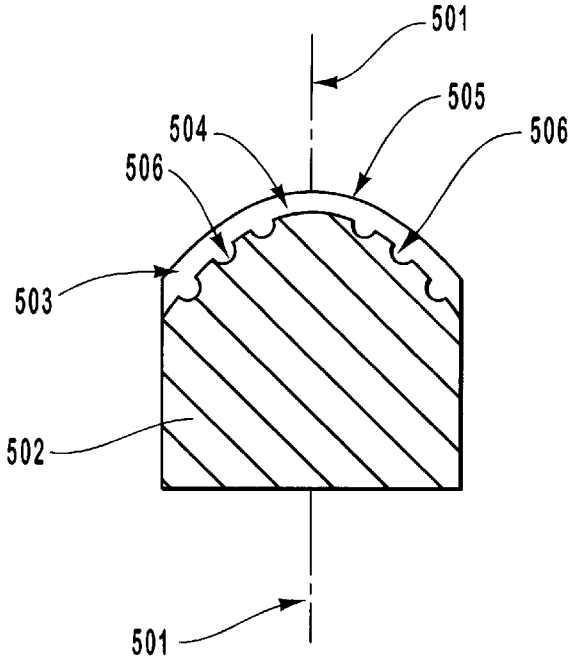
FIG. 5*a* shows a cross-sectional view of an alternative embodiment of the insert invention.
Figure 5B:
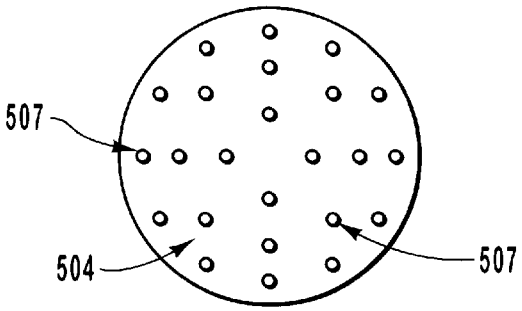
FIG. 5*b* shows a top view of the corresponding substrate that exemplify an embodiment of the present invention.
Figure 5C:
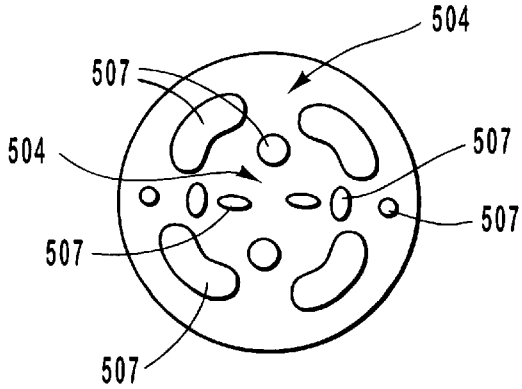
FIG. 5*c* is another top view of the substrate that shows different types of irregularities.

FIG. 5*a* shows an insert's cross section along the insert's longitudinal axis 501. The substrate 502 top surface 504 has irregularities that are exemplified by a plurality of concave features 506 in this cross section, said concave features being separated by unmodified curved portions of the substrate's curved upper surface 504. These concave features may take any shape that confers to them an overall concave curvature. A PCD layer 503 fills these irregularities 506 and covers the substrate's top surface 504 completely. The PCD layer's top surface 505 is also curved. Surfaces 504 and 505 may be both convex (as shown in FIG. 5*a*), or both concave, or one concave and the other one convex. FIG. 5*b* shows a top view of the substrate prior to attachment of the PCD layer. The substrate's top surface 504 contains a plurality of depressions or recesses 507 that correspond to the top views of the plurality of surface irregularities 506 in FIG. 5*a*. The plurality of surface irregularities 506 in FIGS. 5*a* and 5*b* are drawn as extending concentrically outward from the longitudinal axis 501, but their distribution may be uniform or non-uniform, they may be equispaced or irregularly spaced, and their depths and widths may be constant or variable. Furthermore, said surface irregularities 506 may be arranged in a variety of patterns on the substrate's top surface 504. For example, FIG. 5*c* shows a top view of the substrate prior to attachment of the PCD layer, said substrate's top surface containing a plurality of isolated irregularities 507 that is still consistent with the cross section shown in FIG. 5*a*. Furthermore, irregularities 507 do not have to be circular, but they can be ellipsoidal, lenticular, polygonal, or a combination thereof, isolated or interconnected, or of any other shape or combination of shapes that performs the same functions as the embodiment exemplified by FIG. 5*a*, 5*b*, and 5*c*.

Figure 6A:
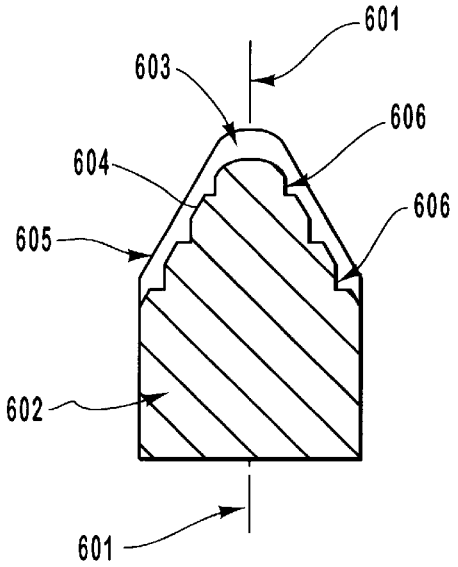
FIG. 6*a* shows a cross-sectional view of an alternative embodiment of the insert invention.
Figure 6B:
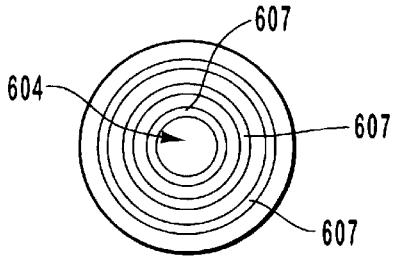
FIG. 6*b* shows the top view of the corresponding substrate that exemplify an embodiment of the present invention.

FIGS. 6*a* and 6*b* show, respectively, an insert's cross section along the longitudinal axis 601, and a top view of the insert's substrate 602 prior to the attachment of the PCD layer 603. FIGS. 6*a* and 6*b* exemplify a feature of the present invention, said feature being that the non-planar substrate's top surface 604 may take a plurality of curved shapes, FIG. 6*a* illustrating the particular example in which said top surface 604 is generally conical and the surface irregularities therein may be any of those described in FIGS. 4*a*, 4*b*, 4*c*, 4*d*, 4*e*, 4*f*, 4*g*, and 4*h* and FIGS. 5*a*, 5*b* and 5*c*. In particular, FIGS. 6*a* and 6*b* show annular features comparable to those represented in FIGS. 4*a* and 4*b*. The PCD layer 603 is represented in FIG. 6*a* as covering the entire top surface 604 of the substrate 602. Consistently with the conventions of the foregoing figures, surface irregularities 606 in the cross-sectional figure correspond to features 607 in the top view represented by FIG. 6*b*.

Figure 7A:
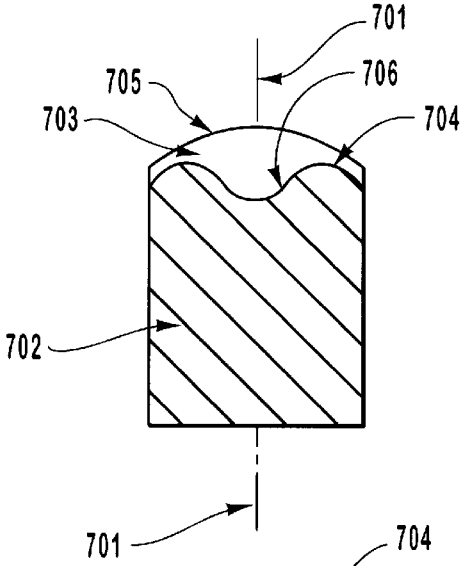
FIG. 7*a* shows a cross-sectional view of an alternative embodiment of the insert invention.
Figure 7B:
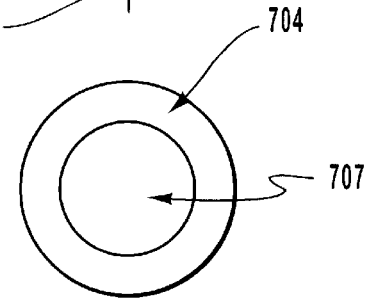
FIG. 7*b* shows the top view of the corresponding substrate that exemplifies an embodiment of the present invention. The polycrystalline diamond layer covers completely the substrate's curved upper surface which has a variable curvature introduced by a single pocket or depression, as shown in FIG. 7*a* and 7*b*.

FIG. 7*a* shows an insert's cross section along the insert's longitudinal axis 701. The substrate 702 top surface 704 has an irregularity that is exemplified by a depression 706 in this cross section, said depression 706 being smoothly integrated into said substrate's top surface 704. A PCD layer 703 fills this depression 706 and covers the substrate's top surface 704 completely. The PCD layer's top surface 705 is also curved. FIG. 7*b* shows a top view of the substrate prior to attachment of the PCD layer. The top view of the substrate's top surface 704 contains a circular shape 707 that corresponds to the top view of the depression 706 in FIG. 7*a*.

The embodiment represented in FIGS. 7*a* and 7*b* illustrates a general preference for the embodiments of the present invention, said preference being materialized by mainly curved features such as curved surface irregularities and interfaces, said interfaces being not necessarily hemispherical. This preference is a further distinction of the present invention from related inventions that rely on protruding ridges or similar features that offer a considerable number of planar or nearly planar intersections and/or linear or nearly linear crossings, said intersections and crossings defining corners and edges that are known to be typical loci of crack formation. Accordingly, substrate surface irregularities in the embodiments of the present invention are designed and manufactured to achieve objectives that include the avoidance of stress concentration and the elimination of preferred directions whose existence could lead to stresses developing in ways that could easily produce cracks. Therefore, short blunt notches or other irregularities whose cross sections analogous to 406, 506 and 706 are functionally equivalent to or have the same purpose as the irregularities herein described, are considered to be comprehended within the scope of the present invention. This preference is also manifest in FIGS. 4*a* and 6*a*, wherein notches are not connected, but separated by curved portions of the substrate top surfaces 404 and 604, respectively, and a plurality of relatively shallow irregularities 406 and 606, respectively, is preferred to deeper irregularities that would imply the presence of sharp features, such as very small angles.

Figure 8A:
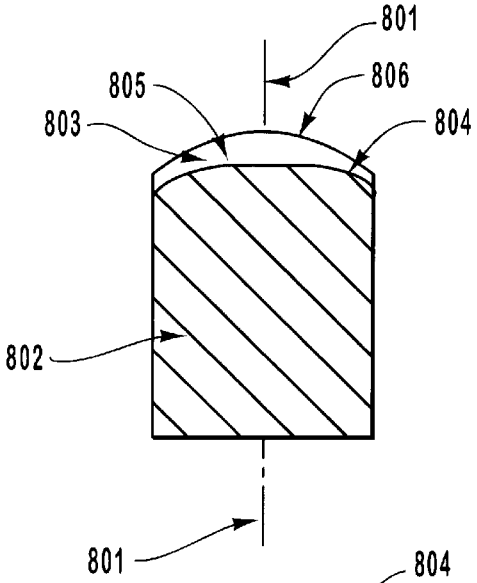
FIG. 8*a* shows a cross-sectional view of an alternative embodiment of the insert invention.
Figure 8B:
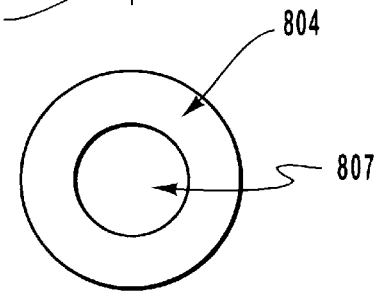
FIG. 8*b* shows the corresponding substrate that exemplifies an embodiment of the present invention. The polycrystalline diamond layer, shown in FIG. 8*a*, covers completely the substrate's curved upper surface which has a curvature interrupted by a planar surface, shown in FIG. 8*b* as the space comprised by the inner circumference.

FIG. 8*a* shows an insert's cross section along the insert's longitudinal axis 801. The substrate's 802 top surface 804 has an irregularity that is exemplified by a plane 806 in this cross section, said plane 806 being smoothly integrated into said substrate's top surface 804. A PCD layer 803 covers the substrate's top surface 804 completely. The PCD layer's top surface 805 is also curved. FIG. 8*b* shows a top view of the substrate prior to attachment of the PCD layer. The top view of the substrate's top surface 804 contains a circle 807 that corresponds to the top view of the plane 806 in FIG. 8*a*. It is intended that the reader understand that instead of the single plane represented as feature 806 in FIG. 8*a*, a plurality of similar planes of the same or different sizes and shapes may be regularly or irregularly distributed on the substrate's top surface 804, said planes being separated from one another by curved and unmodified portions of the substrate top surface 804. Furthermore, the substrate's top surface 804 may be concave or convex and the PCD layer's top surface 805 may also be concave or convex.

The embodiments of the present invention are not confined to substrates with a hemispherical top surface. To further illustrate this important, and distinguishing features, FIGS. 9*a*, 9*b*, 10*a* and 10*b* represent embodiments of inserts that incorporate features of the present invention and that illustrate the fact that the present invention encompasses substrates whose curved top surface is concave, or convex, or it has some concave regions and some convex regions and that the present invention encompasses inserts with substrates that have a combination of groves, depressions, notches and/or other substrate surface modifications as described herein or as is equivalent to the inserts disclosed herein.

Figure 9B:
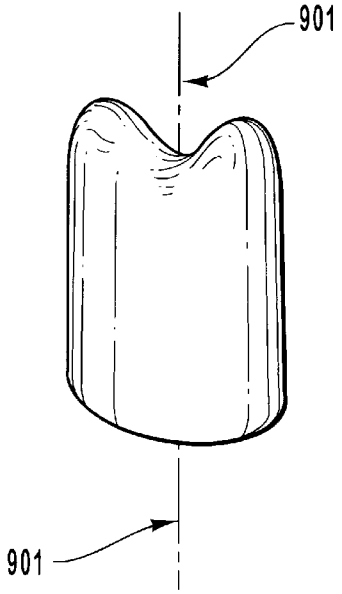
FIG. 9*b* shows the corresponding cross section displaying a feature of the saddle portion of the insert. The polycrystalline layer covers completely the substrate's top surface as shown in FIG. 9*a*.
Figure 9A:
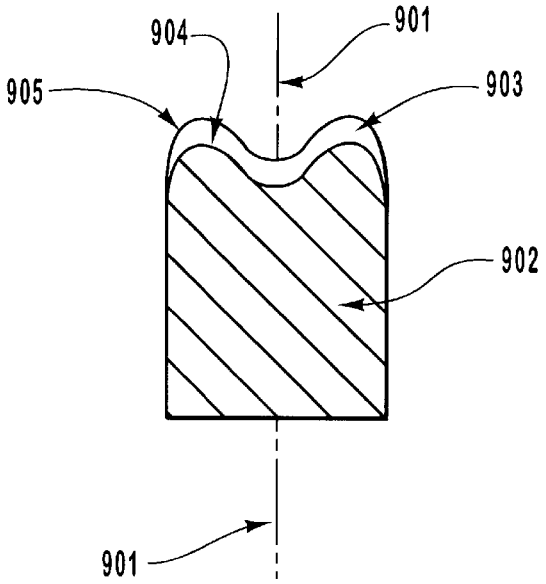
FIG. 9*a* shows a perspective view of an alternative embodiment of the insert invention that has a non-planar surface of variable curvature.

FIG. 9*a* illustrates the external appearance of an insert with a curved top surface, some regions of said top surface having positive curvature, and some other regions having negative curvature. FIG. 9*b* represents a cross section along the longitudinal axis 901 of the insert shown in FIG. 9*a*. The substrate 902 has a curved top surface 904 that is covered by the PCD layer 903, said PCD layer's top surface 905 reproducing the same shape as that of the substrate's top surface 904. The PCD layer 903 may as well cover the substrate's top surface 904 offering a top surface 905 that is convex. Notice that the realization of such embodiment however, does not constitute a reproduction of the embodiment represented in FIGS. 7*a* and 7*b*, for the substrate's top surface 904 in the embodiment represented in FIGS. 9*a* and 9*b* may in fact be shaped like a saddle. Naturally, the substrate's upper surface in FIG. 9*b* may be a smooth surface, or it may have any of the irregularities previously described in discussing the embodiments represented by FIGS. 4*a*, 4*b*, 4*c*, 4*d*, 4*e*, 4*f*, 4*g*, 4*h*, 5*a*, 5*b*, 5*c*, 7*a*, 7*b*, 8*a*, and 8*b*.

Figure 10A:
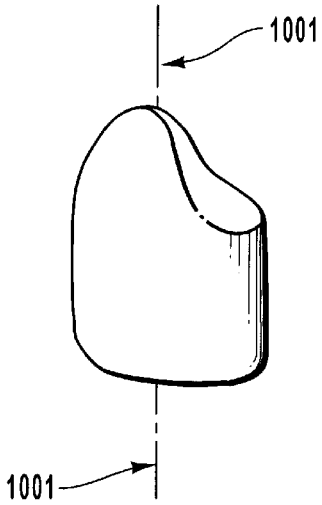
FIG. 10*a* shows a perspective view of an alternative embodiment insert with a top non-planar surface of very irregular curvature.
Figure 10B:
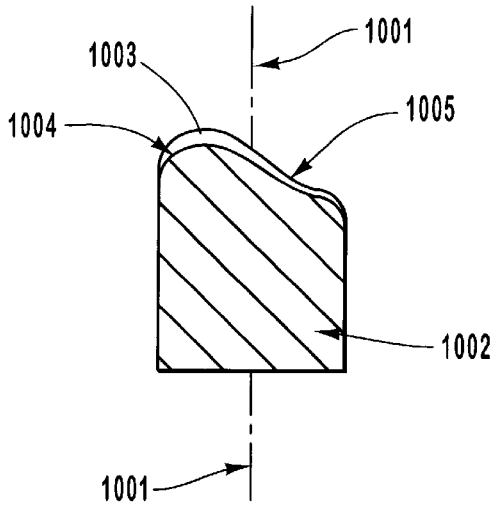
FIG. 10*b* shows the corresponding cross section and shows a layer of polycrystalline diamond covering completely the substrate's top surface.
Figure 11A:
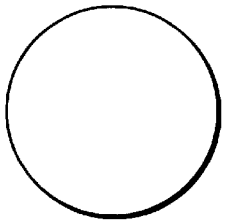
FIGS. 11*a*, 11*b*, 11*c*, 11*d*, 11*e*, 11*f*, 11*g* are illustrations of some, though not all, alternative substrate's cross sections for the embodiments of the present invention that are exemplified by FIGS. 4*a*, 4*b*, 4*c*, 4*d*, 4*e*, 4*f*, 4*g*, 4*h*, 5*a*, 5*b*, 5*c*, 6*a*, 6*b*, 7*a*, 7*b*, 8*a*, 8*b*, 9*a*, 9*b*, 10*a*, and 10*b*.
Figure 11B:
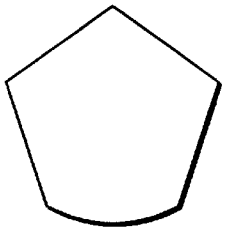
Figure 11C:
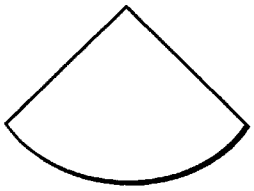
Figure 11D:
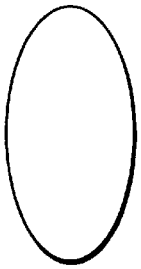
Figure 11E:
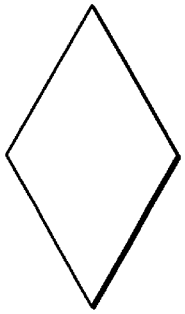
Figure 11F:
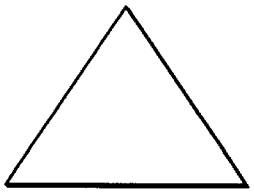
Figure 11G:
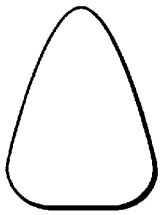

FIGS. 10*a* and 10*b* show another embodiment of the present invention in which the substrate 1002 top surface 1004 is variably curved and non-hemispherical, said substrate's top surface 1004 having a widely varying curvature. Covered completely by the PCD layer 1003, the substrate's

1002 top surface 1004 may be smooth as represented in FIG. 10*b*, or it may have any of the irregularities previously described in discussing the embodiments represented by FIGS. 4*a*, 4*b*, 4*c*, 4*d*, 4*e*, 4*f*, 4*g*, 4*h*, 5*a*, 5*b*, 5*c*, 7*a*, 7*b*, 8*a*, and 8*b*. In addition, FIG. 10*b* illustrates another feature of the present invention. The foregoing figures may have conveyed the impression that the embodiments of the present invention are limited to inserts whose longitudinal axis is a symmetry axis of infinite order, when this feature is not in fact a limitation of the present invention, as illustrated by the insert represented in FIG. 10*a* and 10*b*, wherein a 360-degree rotation about the longitudinal axis 1001 brings the insert into coincidence with itself.

The embodiments of the present invention described so far should not convey the impression that they are limited to a substrate's cross section of cylindrical shape. Whereas this is a common cross section for said part of the insert, the drill inserts for which the present invention provides improved surfaces can be used for purposes other than boring holes. Such other alternative purposes being, for example, cutting, abrading and crushing. The embodiments of the present invention also include, but are not limited to, inserts whose substrate has any of the cross sections exemplified in FIGS. 11*a*, 11*b*, 11*c*, 11*d*, 11*e*, 11*f*, 11*g* or combinations or variations thereof.

As to the method of production of the inserts that constitute embodiments of the present invention. Inserts can be manufactured by modifying the substrate's top surface (with reference numbers 104, 204, 304, 404, 504, 604, 704, 804, 904 and 1004 in the previous figures) prior to or after sintering. Pre-sintering shaping produces irregularities in said substrate's top surface as described in the foregoing discussion, and post-sintering operations are also useful in forming said surface irregularities. These operations include, but they are not confined to grinding, electrode discharge machining, etching, electrode discharge grinding, or a combination thereof.

Once the irregularities are introduced in said substrate's top surface, attachment thereon of the PCD layer (with reference numbers 103, 203, 303, 403, 503, 603, 703, 803, 903 and 1003 in the previous figures), or of any other suitable abrasion and corrosion resistant material, is achieved by sintering. Said layer's upper surface may be finished by additional post-sintering processing to obtain desired surface properties.

Figure 12:
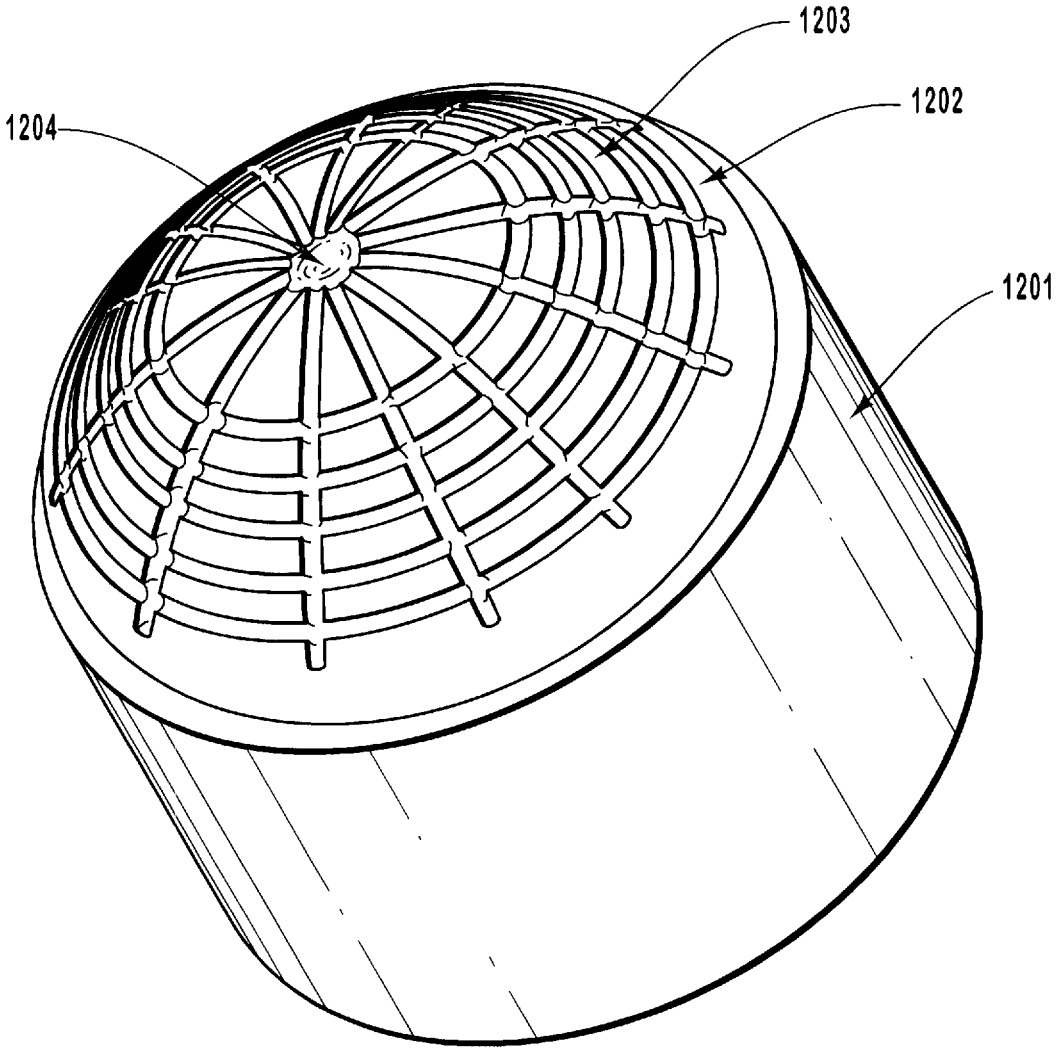
FIG. 12 is a perspective view of the preferred embodiment of the invention.

FIG. 12 shows the preferred embodiment of the invention 1201. In this embodiment radial groves 1202 run outwards from the center 1204 with equally spaced circular grooves 1203 intersecting the radial groves 1202 at right angles.

What is claimed is:

1. A drill bit insert comprising:

(A) a substrate having a curved surface;

(B) a layer of superhard material attached to said substrate;

(C) an interface region, said interface region having irregularities selected from the group consisting of grooves, depressions, indentations, blunt notches, and combinations thereof, connecting said substrate to said superhard material layer; and (D) an upper contact surface on said layer of superhard material.

2. A drill bit insert as recited in claim 1 wherein said substrate further comprises:

(1) an impact resistant composition; and (2) an upper surface; and (3) one or more surface irregularities introduced into said upper surface.

3. A drill bit insert as recited in claim 2 wherein said upper surface further comprises one or more generally convex shapes.

4. A drill bit insert as recited in claim 2 wherein said impact resistant composition is further comprised of a carbide composition.

5. A drill bit insert as recited in claim 2 wherein said one or more surface irregularities further comprise:

(a) a point centrally located on said upper surface;

(b) a pattern generally symmetric about said point; and (c) one or more indentations positioned upon said upper surface in alignment with said pattern.

6. A drill bit insert as recited in claim 1 wherein said surface further comprises a diamond composition.

7. A drill bit insert as recited in claim 1 wherein said substrate has an upper surface and wherein said contact surface further comprises a composition which essentially covers the entirety of said substrate upper surface.

8. A drill bit insert as recited in claim 1, wherein said contact surface is of a generally convex shape.

9. A drill bit insert as recited in claim 1 wherein said interface region is created using mechanical bonding.

10. A drill bit insert as recited in claim 1 wherein said interface region is created using chemical bonding.

11. A drill bit insert as recited in claim 2 wherein said one or more surface irregularities further comprise:

(a) a point centrally located on said upper surface;

(b) a pattern generally asymmetric about said point; and (c) one or more indentations positioned upon said upper surface in alignment with said pattern.

12. A drill bit insert, comprising (A) a substrate having a base feature which is curved and whose properties include being impact resistant, and said substrate defining a longitudinal axis and having:

(1) an upper surface intersecting said longitudinal axis; and (2) a cross section perpendicular to said longitudinal axis, said cross section having one of the perimeters in the group consisting of circular, polygonal, ellipsoidal, ovoidal, and combined rectilinear and arcuate shapes;

(B) a layer whose properties include being abrasion resistant, wherein said layer is attached to said substrate; and (C) an interface region having irregularities selected from the group consisting of grooves, depressions, indentations, blunt notches, and combinations thereof, connecting said substrate to said abrasion resistant layer.

13. A drill bit insert as recited in claim 12 wherein said upper surface of said substrate is non-planar and wherein said upper surface of said substrate further comprises an interior facing side and an exterior facing side.

14. A drill bit insert as recited in claim 13 wherein said upper surface of said substrate has surface irregularities.

15. A drill bit insert as recited in claim 14 wherein said substrate is a transition metal carbide.

16. A drill bit insert as recited in claim 11 wherein said layer further comprises:

(A) a non-planar exterior side, and (B) an interior side where said upper surface of said substrate is attached to said layer.

17. A drill bit insert as recited in claim 12 wherein said layer is one of the polycrystalline substances in the group consisting of diamond, wurtzite boron nitride, cubic boron nitride, and mixtures thereof.

18. A drill bit insert as recited in claim 12 wherein said upper surface of said substrate is formed into a curved shape.

19. A drill bit insert as recited in claim 14 wherein said irregularity of said upper surface of said substrate is selected from the group consisting of grooves, depressions, indentations, blunt notches, protuberances, ribs, planar surfaces, and combinations thereof.

20. A drill bit insert as recited in claim 12 wherein said cross section of said substrate is circular, said layer is continuous, and said upper surface of said substrate has one or more regions and:

(a) a shape that is one of the forms in the group consisting of ellipsoidal, parabolic, hemispheric and conical shapes;

(b) a curvature that is one in the group consisting of convex, concave, and a combination thereof that manifests itself as concave in some said regions and convex in different said regions; and (c) irregularities which are applied to said shape.

21. A drill bit insert as recited in claim 12 wherein said cross section of said substrate is circular, said layer is continuous, and said upper surface of said substrate has:

(a) a shape that is one of the forms in the group consisting of ellipsoidal, parabolic, hemispheric and conical shapes;

(b) a curvature that is one in the group consisting of convex, concave, and a combination thereof that manifests itself as concave in some said regions and convex in different said regions; and (c) irregularities which are applied to said curvature.

22. A drill bit insert as recited in claim 12 wherein said layer has an exterior side and wherein said exterior side of said layer has a curvature that is one in the group consisting of convex, concave, and a combination thereof that manifests itself as concave in some said regions and convex in different said regions.

23. A drill bit insert as recited in claim 12 wherein said layer is attached directly to said upper surface of said substrate, wherein said upper surface of said substrate has irregularities.

24. A drill bit insert as recited in claim 12 wherein said upper surface of said substrate has a generally conical shape.

25. The drill bit insert as recited in claim 24 wherein said layer has an exterior side and one or more regions, and wherein said exterior side of said layer has a curvature that is one in the group consisting of convex, concave, and a combination thereof that manifests itself as concave in some regions and convex in different said regions.

* * * * *